US006692149B2

(12) United States Patent
Baker et al.

(10) Patent No.: US 6,692,149 B2
(45) Date of Patent: Feb. 17, 2004

(54) RE-SEALABLE BAG CLOSURE LABEL AND RELATED METHOD OF MANUFACTURE

(75) Inventors: Bryan T. Baker, Bartlett, TN (US); Guy S. Kiraly, Germantown, TN (US)

(73) Assignee: CCL Label, Inc., Monrovia, CA (US)

( * ) Notice: Subject to any disclaimer, the term of this patent is extended or adjusted under 35 U.S.C. 154(b) by 0 days.

(21) Appl. No.: 10/298,755

(22) Filed: Nov. 18, 2002

(65) Prior Publication Data

US 2003/0081865 A1 May 1, 2003

Related U.S. Application Data

(62) Division of application No. 10/047,300, filed on Oct. 25, 2001.

(51) Int. Cl.[7] ..... B65D 33/00
(52) U.S. Cl. ..... 383/204; 383/203; 383/86
(58) Field of Search ..... 383/86, 203, 204

(56) References Cited

U.S. PATENT DOCUMENTS 3,104,798 A * 9/1963 Stone ..... 383/200
3,327,928 A * 6/1967 Green ..... 229/80
3,557,853 A * 1/1971 Jones ..... 383/86
4,638,912 A * 1/1987 Graf ..... 229/247
4,824,261 A * 4/1989 Provost ..... 383/204
4,955,981 A * 9/1990 Provost ..... 383/86
5,172,980 A * 12/1992 Provost ..... 383/204
6,048,100 A * 4/2000 Thrall et al. ..... 383/86
6,202,260 B1 * 3/2001 Clune et al. ..... 24/30.5 R
6,328,472 B1 * 12/2001 Laurence et al. ..... 383/211
2003/0031386 A1 * 2/2003 Shepard et al. ..... 383/61.1

* cited by examiner

*Primary Examiner*—Robin A. Hylton
(74) *Attorney, Agent, or Firm*—Warner Norcross & Judd LLP

(57) ABSTRACT

A re-sealable container closure label including a base label and a cover label, and a hook-and-loop fastener system and a tamper-evident tear strip is sandwiched therebetween. In a preferred embodiment, the base label is adhered to the front wall of a container, preferably a bag, adjacent an opening in the bag. A flap of the bag is folded downwardly over the opening and adheres to the front wall, the cover label, the two-part hook-and-loop fastener system and the tear strip. In an alternative embodiment, container closure label includes a hook-and-loop fastener system and a tear strip secured only to a base label. This alternative embodiment label is adhered to the front wall of a bag as in the preferred embodiment, except that the flap is adhered directly over the fastener system and tear strip. To open a bag sealed with the re-sealable container closure label, a user pulls the tear strip, which permits the flap to open and form a pour opening. The user may re-seal the flap portion with the hook-and-loop fastener system.

13 Claims, 9 Drawing Sheets

RE-SEALABLE BAG CLOSURE LABEL AND RELATED METHOD OF MANUFACTURE

This application is a division of application Ser. No. 10/047,300 filed Oct. 25, 2001.

BACKGROUND the present invention relates to a re-sealable container including a closure which may be releasably secured in a closed position.

In the packaging industry, it is customary to distribute particulate materials such as dog food, cat food, flour, cereal, fertilizer, cement, and other dry products in a bag, box or other container. Conventional containers, particularly bags, include a front wall, a back wall and side walls, each of the walls having upper and lower ends. Normally, the lower ends of the wall members are folded to form a flap to close the lower end of the bag. The upper end of the bag is closed by folding the upper ends of the wall members downward to create a flap which is glued to the front wall member.

To pour contents from a conventional bag, a user tears a corner of the bag so that the contents may be dispensed or poured through the corner. With the corner tom, however, it is difficult to re-seal or re-close the bag.

One solution to this problem is described in U.S. Pat. No. 6,048,100 to Thrall, which discloses a bag including an upper flap permanently adhered to the front wall of the bag, except for a flap portion near one of the side walls. The flap portion includes a strip of non-stick release liner adhered to it. Strips of exposed adhesive are secured to the front wall of the bag. When the flap is folded over the exposed adhesive, the liner sticks to the adhesive and seals the bag closed along the flap portion. Because of the non-stick material, the closure is movable between a non-sealed open position and a sealed closed position.

Although the Thrall closure facilitates a bag re-sealing, it suffers shortcomings. First, the release liner and exposed adhesive frequently become contaminated with the contents of the bag as those contents are poured. Accordingly, the ability of the closure to remain closed diminishes with use. Second, because the flap portion of the closure is easily pulled from the release liner, it is difficult to detect tampering of the bag.

Another, unrelated closure system is disclosed in U.S. Pat. No. 4,824,261 to Provost. Provost discloses a pair of strips of a hook-and-loop fastening system, identified by the trademark VELCRO. One strip from the pair is hot glued across the width of the front wall of a bag. A second strip is hot glued across a closure flap, to an underside which faces the front wall. A portion of the closure flap that extends beyond the second strip is hot glued to the front wall. A piece of cording is glued to the front wall of the bag under the closure flap. The cording is used to fracture the closure flap and act as a tamper-proof closing for the bag, prior to initial opening.

The tamper-proof re-sealable system of Provost suffers shortcomings as well. First, the velcro strips extend across the width of the bag. Thus, when the strips are pulled apart along a corner, and contents are poured from that corner, the strips tend to separate across the entire width of the bag. This causes excess contents to spill from the bag. Additionally, each of the components of the closure system are individually hot-melt glued to the front wall and flap, which results in increased production costs.

SUMMARY OF THE INVENTION

The aforementioned problems are overcome in the present invention wherein a tamper-proof, re-sealable container closure label includes a hook-and-loop fastener system and a tamper-proof tear strip.

In a first embodiment, a re-sealable container closure label, also referred to herein as a re-sealable bag closure label ("RBCL"), includes a base ply having pressure sensitive adhesive applied to its underside. A pair of strips of hook-and-loop fastening system is adhered to the top side of the base ply. A tear strip also may be adhered to the top of the base ply. Further, a cover ply is adhered over the base ply, sandwiching the pair of strips of a hook-and-loop fastening system and the tear strip between the cover ply and the base ply. Optionally, the tear strip may be replaced with a set of perforations or tear lines in the cover ply adjacent the hook-and-loop fastening system.

In a second embodiment, the RBCL includes a base ply having a pressure-sensitive adhesive applied to its underside. A pair of strips of a hook-and-loop fastening system is adhered over the top side of the base ply. A tear strip, string, cord, tape, or the like is adhered to the top of the base ply. Further, the base ply or tear strip may include a tab so that the tear strip may be easily grasped by a user.

In a preferred process of applying the RBCL to a conventional bag, the RBCL is first secured to a front wall of a bag before a closure flap of the bag is closed and sealed against the front wall. Preferably, the RBCL is adhered to a corner of the bag, near an upper end of the front wall. The RBCL may also extend across the width or other portion of the bag if desired. As will be appreciated, the RBCL of the present invention may also be applied to and used with other conventional containers, for example, boxes, in a similar manner. An adhesive, such as a hot-melt glue, is applied over the front wall of the bag and the RBCL, preferably over the area coinciding with the tear strip and the hook-and-loop system of the RBCL. The closure flap is folded over and against the hot-melt glue, thereby sealing and closing the bag over the front wall and the RBCL. When the closure flap is hot-melt glued over the first embodiment RBCL the flap preferably overlays both the strips of hook-and-loop fastening system and the optional tear strip. But when the closure flap is hot-melt glued over the second embodiment RBCL, the flap adheres to the second ply, overlapping the hook-and-loop fastening strips, but not the tear strip or set of perforations.

To open a bag or box including the RBCL, a user grasps and pulls the tear strip of the RBCL. With regard to the first embodiment explained above, this action fractures the closure flap to make an opening flap. With regard to the second embodiment explained above, this action only tears the second ply of the RBCL to make an opening flap. The opening flaps of either embodiment may then be pulled away from the front wall to separate the strips of the hook-and-loop fastening system thereby opening the container. A user may close and re-seal the container by closing the opening flap and pressing together the strips back into releasable attachment with one another.

The RBCL of the present invention provides a tamper-proof, re-sealable and reclosable container closure system with many benefits. First, the closure system is self-contained, that is, multiple individual parts need not be individually hot-melt glued to a container. Second, the hook-and-loop fastening system is reliable and not easily contaminated when contents are poured from the bag. Finally, with regard to the second embodiment including a cover ply over the hook-and-loop system, the possibility of contaminating the hook-and-loop system with hot-melt glue as the RBCL is applied to a container is greatly diminished, thereby reducing the number of defective, difficult-to-open closure systems.

These and other objects, advantages and features of the invention will be more readily understood and appreciated by reference to the detailed description of the preferred embodiments and the drawings.

DETAILED DESCRIPTION OF THE PREFERRED EMBODIMENTS

I. Re-Sealable Bag Closure Label Construction

Figure 1:
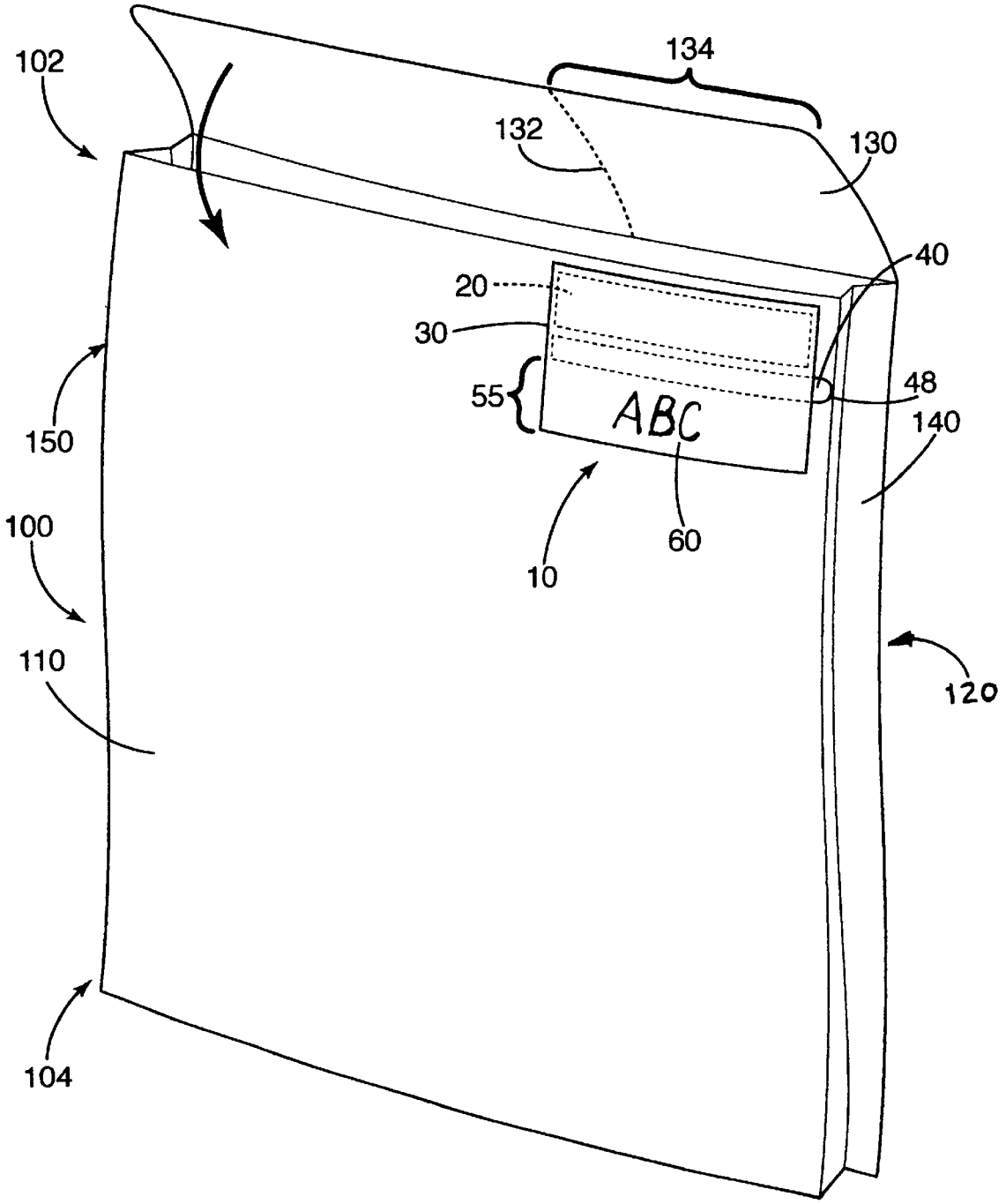
FIG. 1 shows a preferred embodiment of an RBCL of the present invention attached to a bag.
Figure 2:
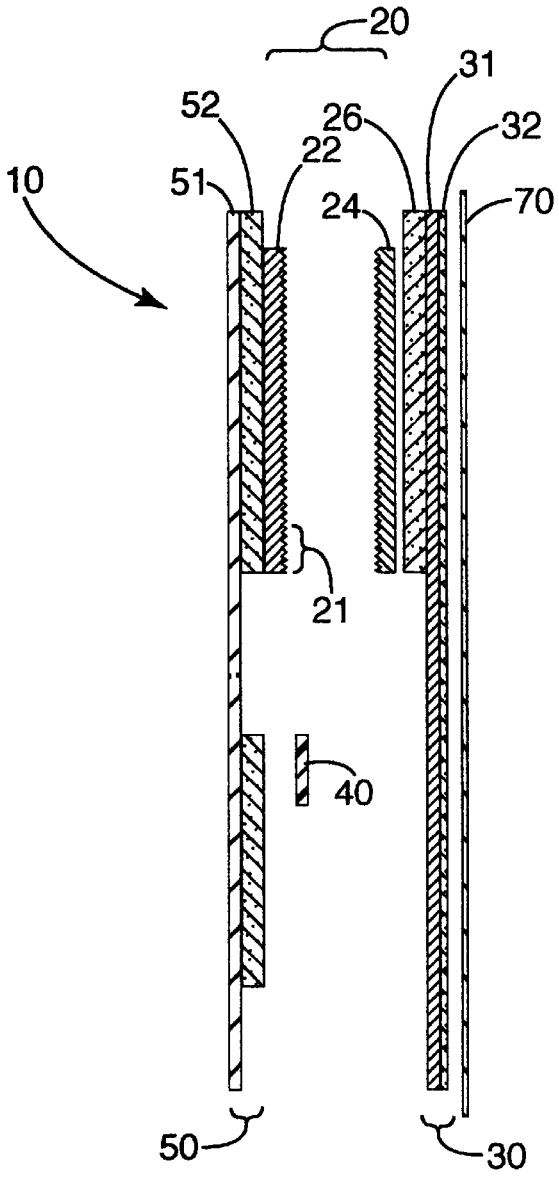
FIG. 2 is an exploded side view of the RBCL.
Figure 3:
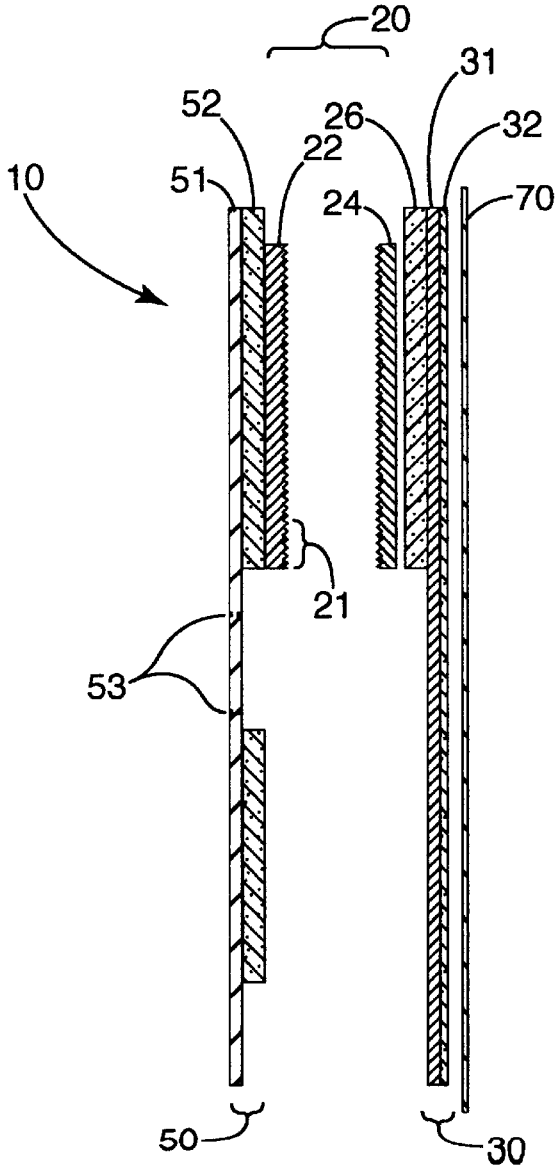
FIG. 3 is an exploded side view of the RBCL without a tear strip.

FIG. 1 shows a re-sealable bag closure label ("RBCL") of the present invention affixed to a bag 100 before the bag is sealed closed. FIG. 2 shows in more detail the preferred RBCL, which includes base label 30, cover label 50, and hook-and-loop fastening system 20 along with tear strip 40 sandwiched between the base label 30 and cover label 50. The base label 30 includes base ply 31 and adhesive layer 32, which is preferably a pressure sensitive adhesive but may be substituted with any commercially available adhesive. Cover label 50 includes cover ply 51 and adhesive layer 52. Optionally, indicia 60 may be printed on an information field area 55.

With reference to FIG. 1, the RBCL is preferably attached to a bag for containing dog food, cat food, flour, cereal, fertilizer, cement, or other particulate products, however, the RBCL may also be attached to boxes or other containers as discussed below. The preferred bag includes back wall 120, front wall 110, side walls 140 and 150 which are preferably foldable, and which extend between front and back walls 110 and 120. Bag 100 generally includes upper 102 and lower 104 ends. The bag may be constructed of paper, plastic, synthetic materials or any combination thereof. Optionally, the bag 100 may be of tubular construction including a closed bottom and an opening, opposite the end of the closed bottom which includes a flap portion for closure over the opening (not shown).

The bag shown in FIG. 1 may be formed in any manner, for example, by folding the ends of the front wall, back wall, and side walls on one another to form a flap that is glued or otherwise secured to the back wall 120 at lower end 104. At the upper end 102, the front wall 110 may terminate short of the back wall 120 to form a closure flap 130 which is foldable over the front wall 110. Optionally, the closure flap 130 may include a perforation or tear line 132. If included, perforation or tear lines 132 are positioned so that opening flap 134 aligns next to an edge of the RBCL 10 when the closure flap 130 is folded over onto the front wall 110.

With reference to FIGS. 1 and 2, the RBCL is generally rectangular in shape, however, other shapes may be used. As shown, the RBCL 10 is positioned at a corner of the bag; however, the RBCL may be positioned anywhere, and be of any dimension. For example, RBCL 10 may extend across the upper end 102 of the bag halfway, completely, or any other desired portion. With particular reference to FIG. 2, RBCL includes base label stock 30 which includes base ply 31 and an adhesive 32 applied on the underside thereof. The base ply 31 may be constructed of paper, foil, plastic or any combination thereof. Preferably, the adhesive 32 is a pressure-sensitive adhesive; however, other commercially available adhesive is acceptable. Optionally, release liner 70 is secured to the underside of the base ply 31 over the adhesive 32 to prevent contamination of the adhesive 32 before the RBCL is applied to a bag. As will be appreciated, the liner is removed to apply the RBCL 10 to a bag. The RBCL may be manufactured in continuous web form and applied to articles directly from the web (not shown). Alternatively, the RBCL may be manufactured in sheet form (not shown). In either web, sheet or other conventional forms, individual RBCLs may be removed from the carrier web or sheet and automatically or manually applied to articles as desired.

Cover label 50 is disposed over select portions of the base ply 31, the fastening system 20 and tear strip 40. Preferably, the cover label includes cover ply 51, which may be constructed of paper, foil, plastic or any combination thereof. Preferably, the adhesive 52 is a pressure-sensitive adhesive; however, other commercially available adhesive is acceptable. Optionally, the visible side of a cover label 50 may include information field portion 55, including instructional or other indicia 60.

The tear strip 40 preferably is constructed from a synthetic material identified by the trademark NYLON, but any stranded, fibrous or other commercially available tear strip material may be used. Optionally, the tear strip 40 may be replaced with any cording, string, tape or the like that is capable of fracturing cover ply 51 to act as tamper-proof closure for the bag 10 before opening. Moreover, the tear strip 40 may be coated with a silicone or wax layer (not shown).

Preferably, the adhesive layer 52 overlays the tear strip 40 to hold the strip in place as it is sandwiched between the cover label 50 and base label 30. Preferably, the adhesive overlays the strip 40 to the edge of the strip, however, the adhesive 52 is also effective if it overlays tear strip 40 to lesser degrees, for example, if adhesive only overlays half of the strip.

In yet another alternative structure corresponding to tear strip 40, the tear strip may be absent from the RBCL, and instead, closure flap 130 specifically, the opening flap 134, may include perforations or tear lines (not shown) adjacent and parallel to the hook-and-loop fastening system 20. Optionally, the tear strip 40 includes a grasping tab 48 that extends beyond the base label 30 to facilitate grasping thereof by a user. The grasping tab may be alternatively incorporated into the base ply 31, cover ply 51, the strength strip 40, or any combination thereof as desired.

The RBCL 10 as shown in FIGS. 1 and 2, preferably includes a pair of strips 22 and 24 of a hook-and-loop fastening system identified by the trademark VELCRO. As will be appreciated, other touch fastener systems may be used as well. Strip 24 is adhered to the base label 30 preferably with a pressure-sensitive adhesive, however, any conventional adhesive such as hot-melts may be used to secure the strip 24 to the base label 30. In the preferred embodiment, the strips 22 and 24 include corresponding hooks and loops. Optionally, a portion of the hooks or loops may be absent in a region such as 21 to facilitate disengagement of the strips from one another or to provide a gripping surface without causing the hook strip 24 from delaminating from the base ply when the loop strip 22 is disattached from the hook strip 24.

II. Applying the RBCL to a Container

With reference to FIGS. 1, 2 and 4–7, a preferred method of applying the preferred RBCL of the present invention to a container will now be described. With reference to FIG. 1, an RBCL is applied to a bag prior to the closing and sealing of the closure flap 130 against the front wall of the bag 110. As will be appreciated, the label may be applied during the manufacture of the bag or before the filling and sealing of the bag.

Figure 4:
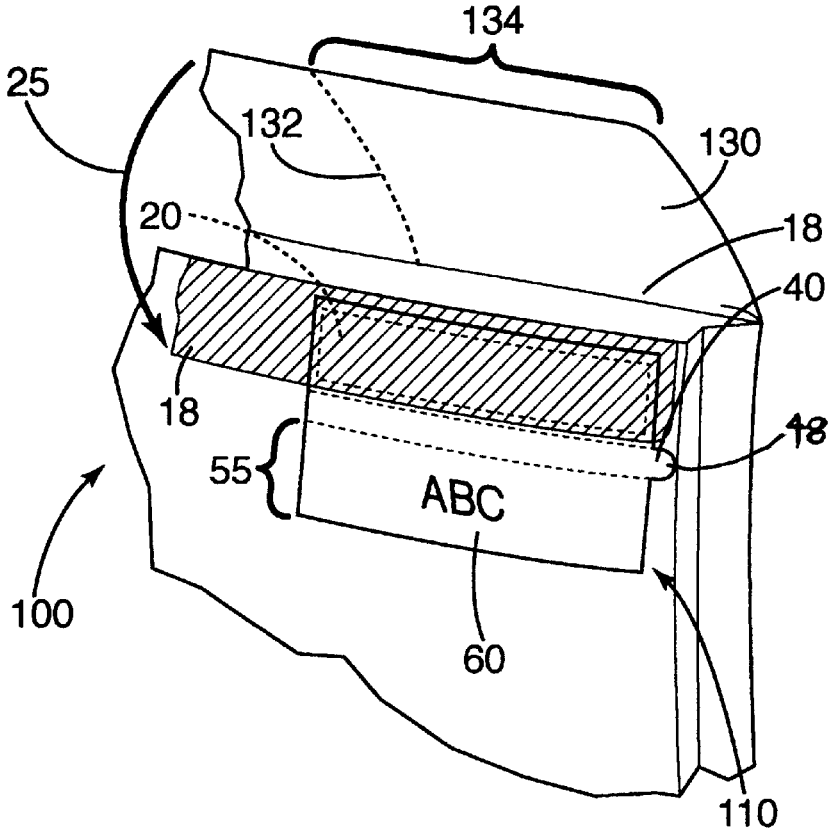
FIG. 4 is a perspective view of adhesive applied over the RBCL in a preferred process of applying the RBCL to a bag.

In either case, to seal the closure flap 130 against the front wall 110 of the bag, an adhesive, preferably a hot-melt glue 18, is applied over the front wall of the bag and the RBCL 10, in particular, over the hook-and-loop system 20 but short of the strip 40 as shown in FIG. 4. As will be appreciated, to seal the closure flap 130 to the front wall 110 of the bag and over the RBCL 10, hot-melt glue 18 alternatively may be applied directly to the closure flap 130 in an area coinciding with the hook-and-loop system 20. Optionally, the hot-melt glue 18 may be coated over a portion of the strip 40 as the application requires.

Figure 5:
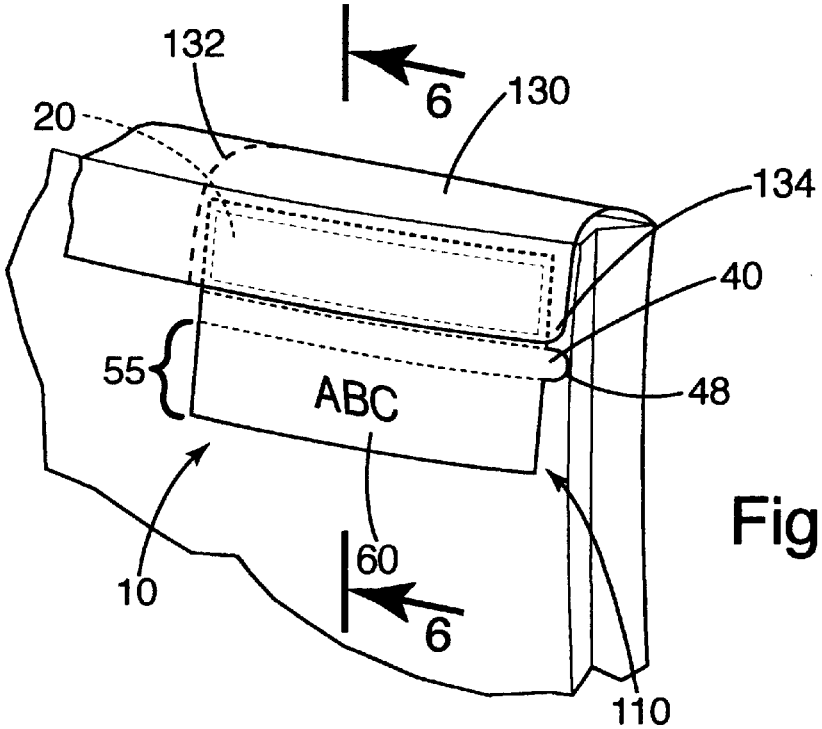
FIG. 5 is a perspective view of a bag closure flap folded over the RBCL.

As shown in FIGS. 4 and 5, after the closure flap 130 is folded over and secured to the front wall 110 and RBCL 10, the flap is closed and sealed. In this configuration, the bag 100 is typically distributed to end users. With the closure flap 130 sealed against the front wall 110 of the bag, the bag is tamper-proof. Before initial opening, the tear strip 40 must be pulled to fracture the cover ply 51 (FIG. 2) or the closure flap 130 must be otherwise torn to open the bag 100.

Figure 6:
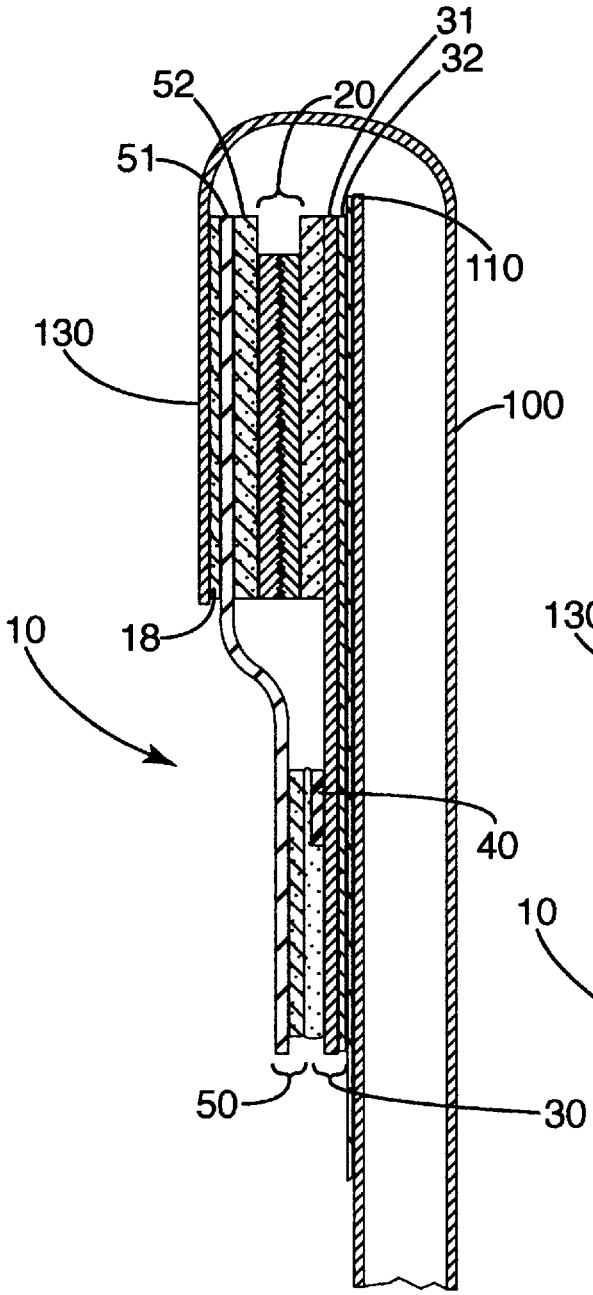
FIG. 6 is a sectional view of the RBCL secured to the bag taken along line 6—6 of FIG. 5.
Figure 7:
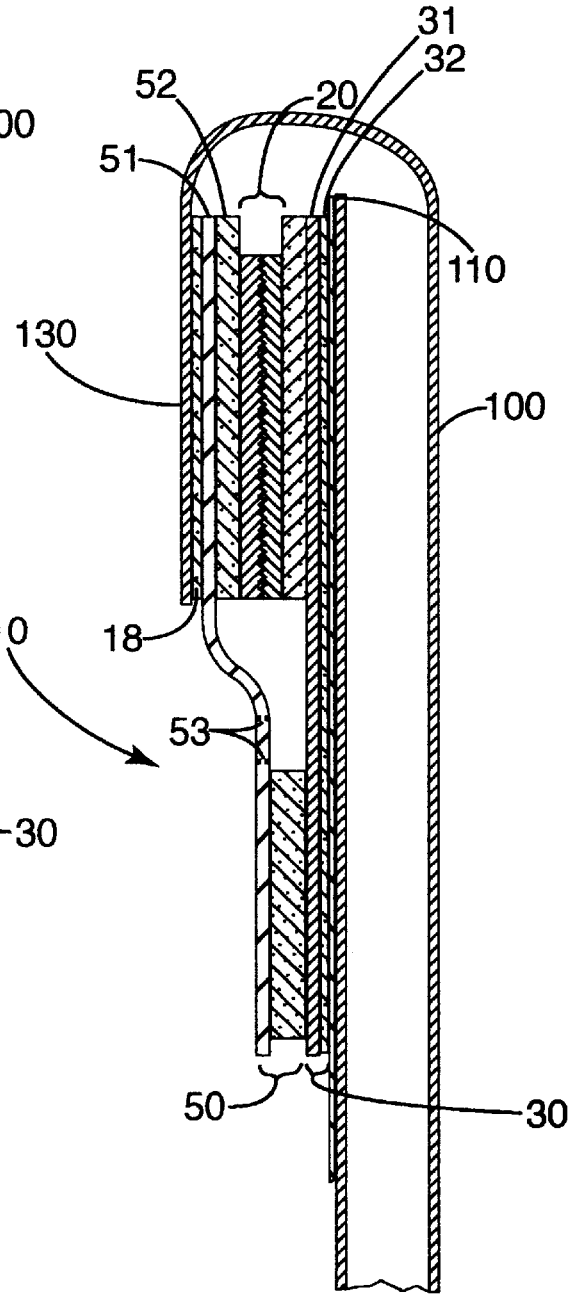
FIG. 7 is a sectional view of the RBCL without a tear strip secured to the bag taken along line 6—6 of FIG. 5.

With particular reference to FIG. 6, interaction of the bag 100 and the preferred RBCL 10 is better understood. Closure flap 130 is secured over the cover ply 51 in an area coinciding with the hook-and-loop fastening system 20 with hot-melt glue 18. The bag is maintained in its closed position by virtue of the closure flap 130 being secured to the cover label 50 which is further secured to base label 30 which is also secured to front wall 110. Preferably, the cover flap 130 does not overlap the tear strip 40. However, in certain circumstances, overlap may be desired. FIG. 7 depicts the interaction of the bag and an RBCL 10 that does not include a tear strip 40 but rather includes perforations 53. This label is applied to the bag 100 in a manner similar to that in connection with the preferred embodiment of FIG. 6.

III. Method of Use

Figure 8:
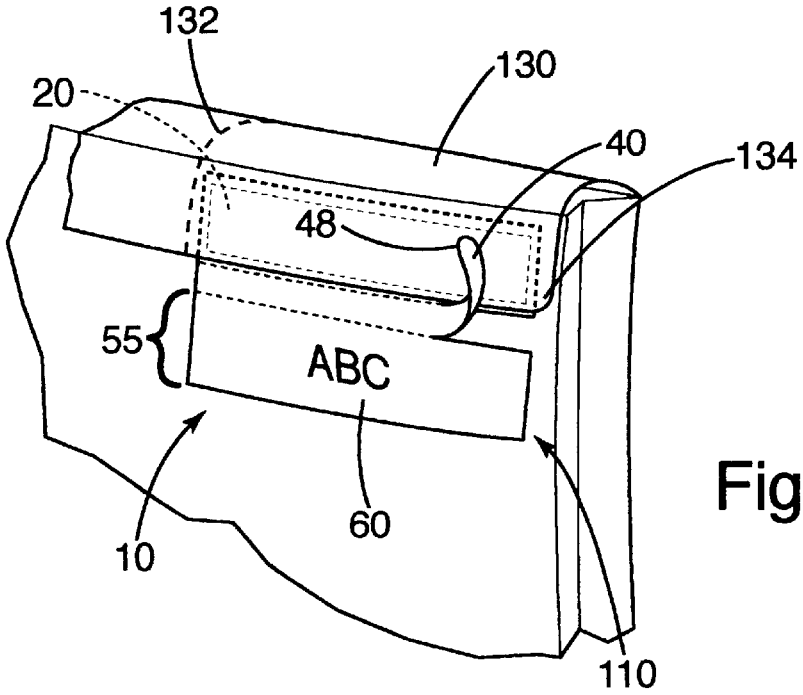
FIG. 8 is a perspective view of the RBCL being used to open the bag.
Figure 9:
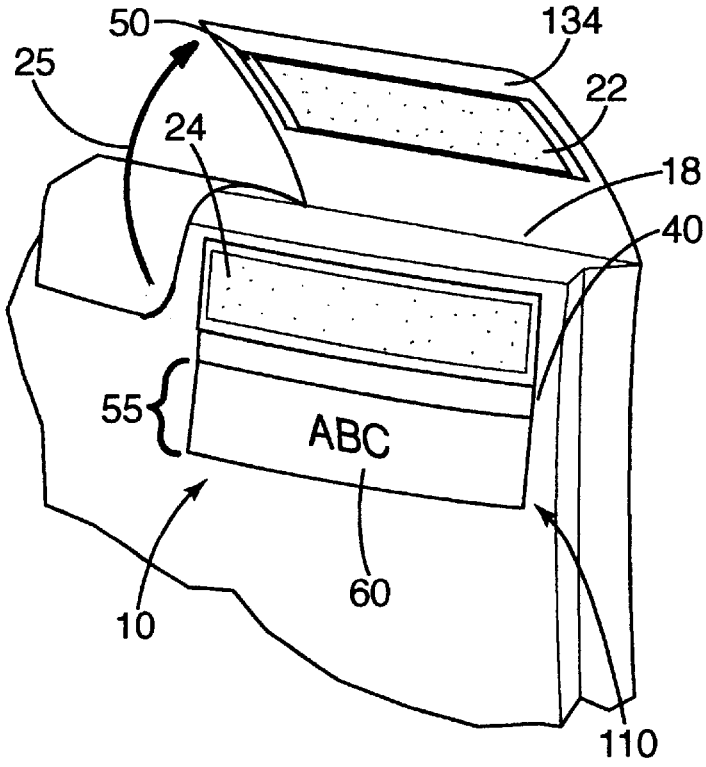
FIG. 9 is a perspective view of the RBCL following the initial opening of the bag in of FIG. 8.

With reference to FIGS. 8 and 9, the method of using the RBCL of the present invention will now be described. To open the bag 100, a user grasps tab 48 and pulls the tear strip 40 away from the RBCL 10. Accordingly, the tear strip 40 tears through the cover label 50 (FIG. 6) to release the opening flap 134. Preferably, the user pulls the tear strip 40 so that the closure flap 130 is torn all the way to the perforation or tear line 132.

As shown in FIG. 9, to completely open the corner of the bag, a user grasps the opening flap 134 adjacent the area where the tear strip was previously disposed and applies a peeling force thereto to lift the opening flap 134 as indicated by arrow 25. Once the strips 22 and 24 are separated by the user pulling the opening flap 134 in direction of arrow 25, the opening flap 134 can be lifted to provide an opening in the bag 100. Closure and resealing of the bag may be performed in operations reversed from those described above. For example, the opening flap 134 is pushed back against front wall 110 and RBCL 10 so that the hook-and-loop strips 22 and 24 may be pressed together into attachment.

IV. First Alternative Embodiment

Figure 10:
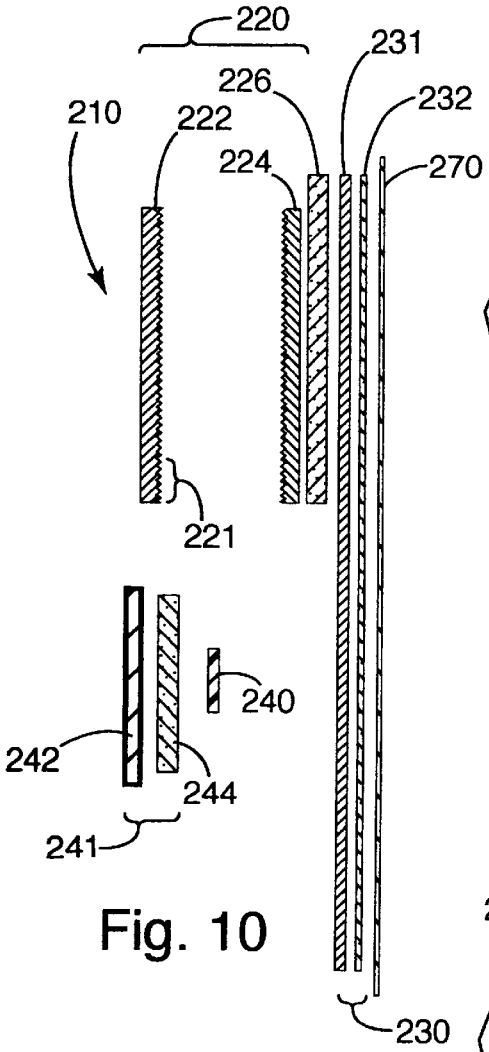
FIG. 10 is a first alternative embodiment of the RBCL.
Figure 11:
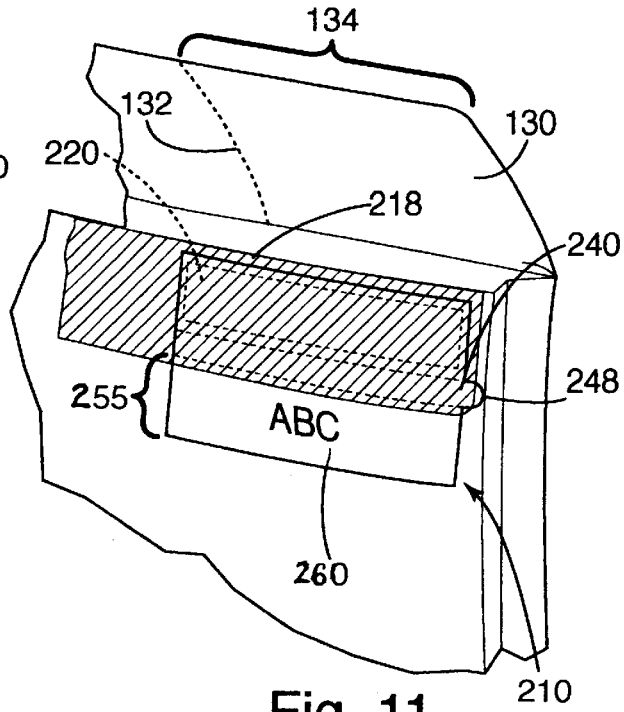
FIG. 11 is a perspective view of the RBCL of the first alternative embodiment being applied to a bag in an alternative process.

A first alternative embodiment of the RBCL 210, shown in FIG. 10 includes base label 230 to which hook-and-loop system 220 and tear strip 240 are secured. As with the preferred embodiment, base label may include indicia 260 printed on an information field portion 255 (FIG. 11). The base label 230 and hook-and-loop fastening system 220 may be identical to that of the preferred embodiment and will not be described in detail here.

In the embodiment of FIG. 10, tear strip 240 is secured to the base ply 231 with tear strip label 241 including tear ply 242 optionally constructed of paper, plastic or foil stock and adhesive 244 which is preferably pressure sensitive. The tear strip 240 may be identical to that of the preferred embodiment. As with the preferred embodiment, the tear strip 240 may be replaced with cording, string, tape or the like. Optionally, the tear strip 240 and tear label 241 may be absent and, as with the preferred embodiment, replaced with perforations or tear lines incorporated into a closure flap (not shown) of the container. Of course, both perforations and tear lines as well as the tear strip 240 may be used in combination as desired. Moreover, the tear strip may be coupled to a grasping tab 248 (FIG. 11) that extends beyond the base label 230 to facilitate grasping thereof by user. The grasping tab may be incorporated into the base ply 231, the tear stock 242, the tear strip 240, or any combination thereof as desired.

As with the preferred embodiment, the fastening system 220 may include a portion 221 where either the hooks or loops of portions 222 or 224 are absent to facilitate tearing apart of the hooks-and-loops portion 222 and 224 by a user.

Figure 12:
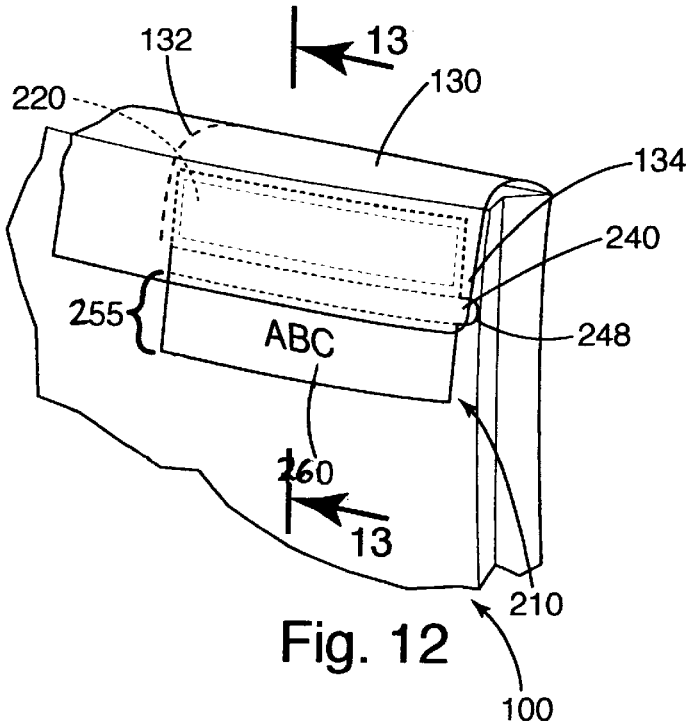
FIG. 12 is a perspective view of a bag closure flap folded over the RBCL of the first alternative embodiment.

Application of the first alternative embodiment of the RBCL 210 is shown in FIGS. 11 and 12 and is generally similar to the application process of the preferred embodiment shown in FIGS. 4 and 5 with one exception; the hot-melt glue 218 contacts both the fastening system and the tear label 241 and secures the closure flap over both. As will be appreciated, the hot-melt glue 218 or other adhesive may be deposited directly over the RBCL 210 and front wall of the bag 110 or coated directly on the closure flap 130. As will further be appreciated, the label may be applied during manufacture of the bag or before the filling and sealing of the bag as in the preferred embodiment.

Figure 13:
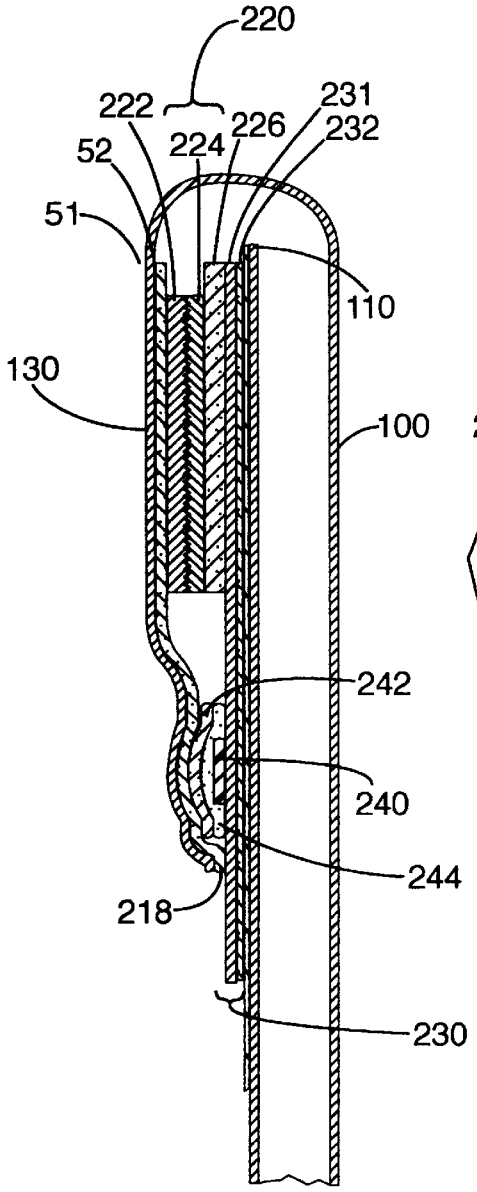
FIG. 13 is a sectional view of the RBCL of the first alternative embodiment taken along line 13—13 of FIG. 12.
Figure 15:
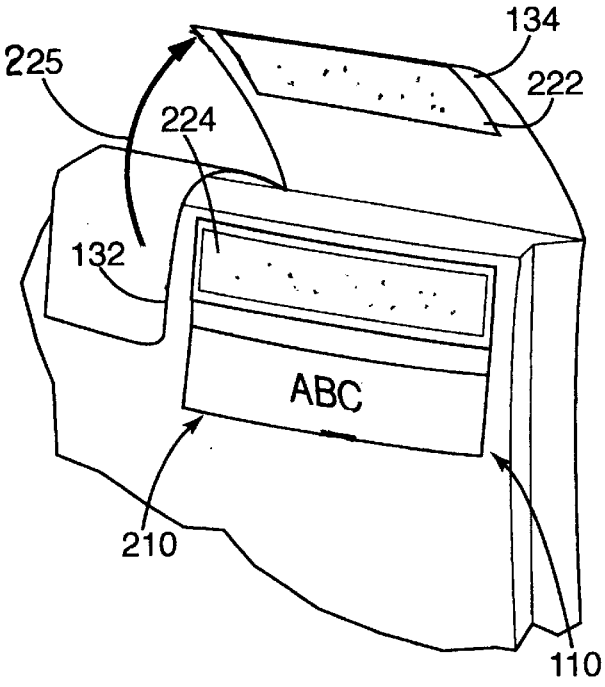
FIG. 15 is a perspective view of the RBCL of the first alternative embodiment following the initial opening of the bag in FIG. 13.

As shown in FIGS. 12 and 13, the closure flap 130 is sealed to the front wall 110 of the bag 100. With particular reference to FIG. 13, the sealed hot-melt glue 218 secures the closure flap 130 to the fastening system 220 and the tear strip ply 242 in a portion of the base ply 231. As will be appreciated, the degree of overlap of the closure flap 130 and base ply may be varied as desired. The method of using the RBCL 210 of the first alternative embodiment is virtually identical to the use of the RBCL of the preferred embodiment and will only be briefly described here. To initially open the bag, the tear strip 241 is grasped by a user, preferably at grasping tab 248. By pulling on tear strip 241, the closure flap 130 is fractured as depicted. The user continues to pull the tear strip 241 until it reaches the perforations 132. Thereafter, the opening flap 134 may be opened in direction 225 as depicted in FIG. 15. Re-closing the bag is similar to that of the preferred embodiment.

V. Second Alternative Embodiment

Figure 16:
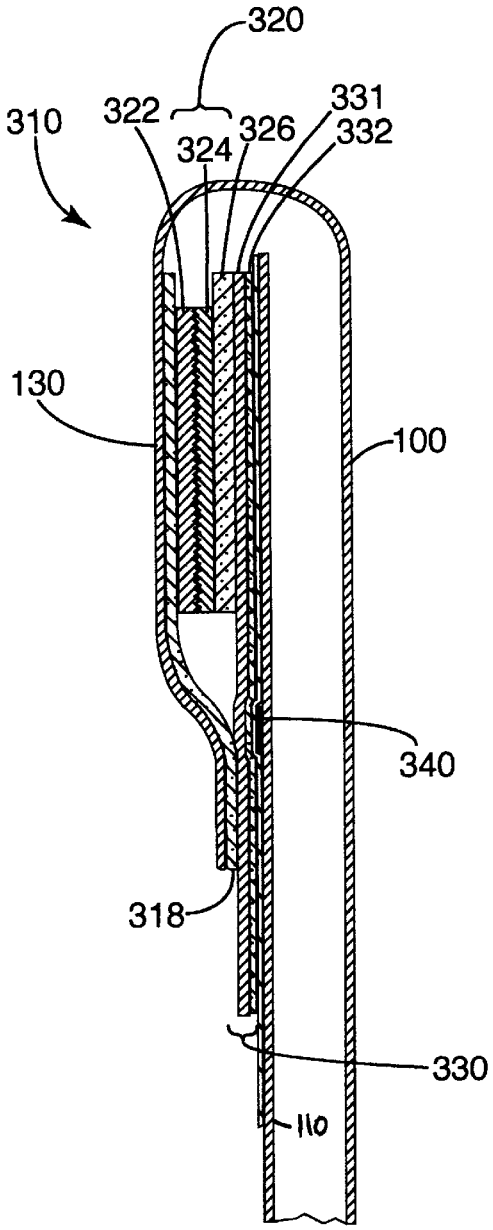
FIG. 16 is a sectional view of a second alternative embodiment of the RBCL.

A second alternative embodiment of the RBCL, shown attached to a bag in FIG. 16, includes a base ply 331 to which a pair of hook-and-loop strips 322 and 324 are adhered via adhesive 326, which may be a pressure-sensitive adhesive or other commercially available adhesive. Adhesive 332 is applied to the base ply 331 opposite the hook-and-loop system strips 322 and 324. The hook-and-loop system 320 operates in a manner consistent with that described in connection with the preferred embodiment. Preferably, adhesive 332 is pressure-sensitive, but other commercially available adhesives will work as well. Additionally, on the side of the base ply 331 opposite the hook-and-loops strips 322 and 324, a tear strip member 340 is disposed. Optionally, the tear strip member 340 may include a tab for grasping (not shown).

Figure 14:
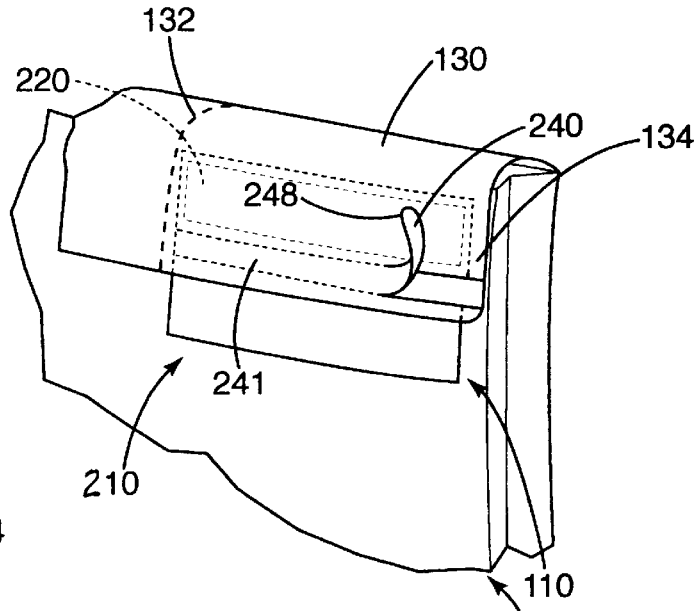
FIG. 14 is a perspective view of the RBCL of the first alternative embodiment being used to open the bag.

Application of the RBCL 310 shown in FIG. 16 is similar to application of the RBCL of the preferred embodiment depicted in FIGS. 4 and 5. The closure flap 130 is secured over the RBCL 310 with a hot-melt glue or other adhesive 318. However, the closure flap 130 is secured with hot-melt glue to only the base ply 331 and the hook-and-loop layer 322. Because the tear strip 340 is under the base ply 331, the glue is not directly applied thereto. The operation of the RBCL 310 of the alternative embodiment is similar to that of the RBCL in the preferred embodiment shown in FIGS. 14 and 15. Specifically, a user may grasp the tear strip member 240, pull outward from the front wall 110 and tear the adhesive 218, closure flap 130 and the base ply 231. As will be appreciated, where the closure flap 130 does not overlap the tear strip, that flap is not fractured on opening.

VI. Other Applications

Figure 17:
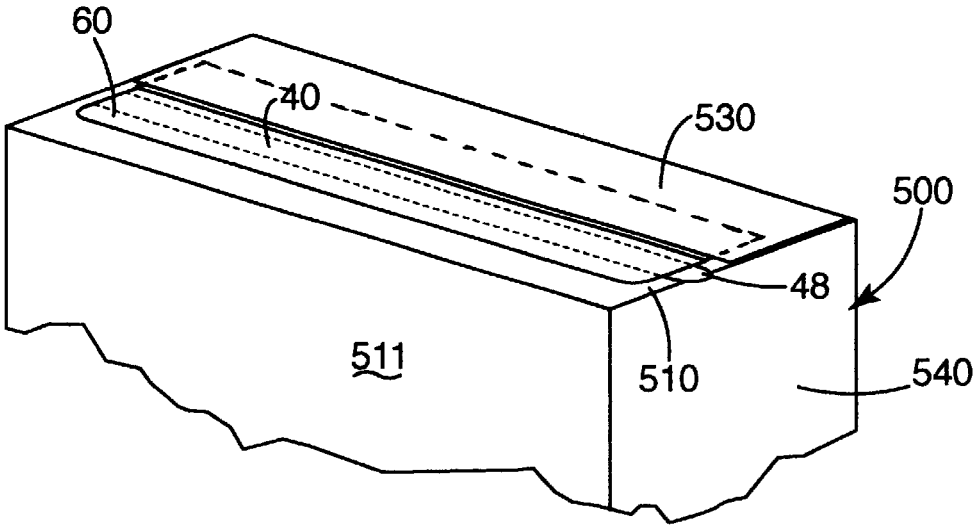
FIG. 17 is a perspective view of the RBCL of the present invention installed on a first box.
Figure 18:
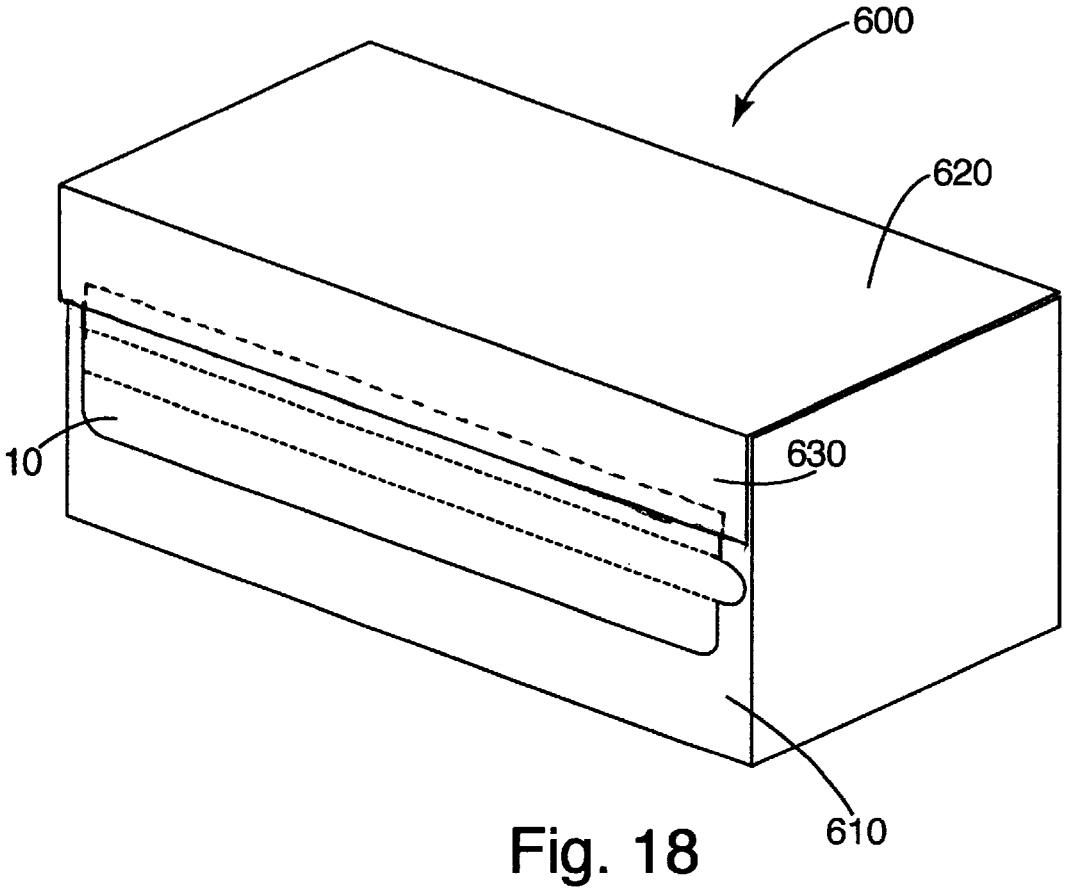
FIG. 18 is a perspective view of the RBCL of the present invention installed on a second box.

As will be appreciated, the RBCL of the present invention may be used in connection with a variety of containers in addition to bags. For example, with reference to FIGS. 17 and 18, the RBCL 10 of the preferred embodiment may be disposed between a first flap 510 and second flap 530 of a box 500. As will be appreciated, although the RBCL depicted is that of the preferred embodiment 10, any of the embodiments of the RBCLs disclosed herein may be substituted therefore. The application and operation of RBCLs to boxes is similar to that of the embodiments above and therefore will not be explained again in detail here. Of course, the structure of the box to which the RBCLs may be combined may differ. For example, the box of FIG. 18 includes a top side 620 including a flap portion 630. In this application, the RBCL is disposed on the front wall 610 of the box 600. The flap portion 630 may then be secured to the RBCL in any of the manners described above. Likewise, the operation of the RBCL 10 in connection with the box of the configuration depicted in FIG. 18 is similar to that explained above in other embodiments.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

What is claimed is:

1. A re-sealable container system comprising:

a container having an upper end and including a front wall, a back wall and a flap joined with said back wall, said flap folded downwardly adjacent said front wall; and a re-sealable container closure label including:

a base having a first side and a second side;

a pair of strips of a hook-and-loop fastening system secured to said first side;

a cover secured over at least a portion of said fastening system; and means for tearing said cover, said re-sealable container closure label disposed between said front wall and said flap, said flap secured over said pair of strips, said second side adhered to said front wall whereby the upper end of said container is sealed closed.

2. The re-sealable container system of claim 1 wherein at least one of said front wall and said flap is adhered directly to said fastening system.

3. The re-sealable container system of claim 1 wherein the cover is adhered over said fastening system.

4. The re-sealable container system of claim 3 wherein at least one of said front wall and said flap is adhered directly to said cover.

5. A re-sealable container system comprising:

a container having an upper end and including a front wall, a back wall and a flap, said flap joined with said back wall and folded downwardly adjacent said front wall; and a re-sealable container closure label including:

a base having a first side and a second side;

a hook-and-loop fastening system secured to said first side, said re-sealable container closure label disposed between said front wall and said flap, said flap secured over said hook-and-loop fastening system, said second side adhered to said front wall whereby the upper end of said container is sealed closed;

a cover secured to at least one of the base and the hook-and-loop fastening system; and a tear member adjacent said hook-and-loop fastening system, said tear member secured to at least one of said first and second sides of said base.

6. The re-sealable container system of claim 5 wherein said tear member is adjacent said hook-and-loop fastening system and disposed between said flap and said front wall so that when said tear member is pulled by a user, it fractures said flap, whereby the user may open the upper end of the container.

7. The re-sealable container system of claim 5 wherein said re-sealable container closure label extends across the upper end of said container between said flap and said front wall.

8. The re-sealable container system of claim 5 wherein the re-sealable container closure label is disposed between said flap and said front wall.

9. The re-sealable container system of claim 8 wherein said flap is sealed to said front wall member except for a portion of the flap adjacent said re-sealable container closure label.

10. The re-sealable container system of claim 1 wherein said flap includes at least one from perforations and tear lines so that when a user pulls said flap, said flap tears whereby a user may separate said strips and open said upper end of said container.

11. A re-sealable container system comprising:

a container including a front wall, back wall and a flap joined with said back wall and adapted to fold over said front wall;

a base label having a first side and a second side, one of said first and second sides adhered to at least one of the flap and the front wall;

a pair of hook-and-loop fasteners secured to the other of said first side and said second side, the other of the flap and the front wall secured over the pair of fasteners, wherein the pair of fasteners resealably close the container;

a cover label secured to said base label; and a tear strip joined with at least one of said base label and said cover label whereby removal of said tear strip enables separation of the flap from the front wall.

12. The re-sealable container system of claim 11 wherein the cover label is disposed between one of the pair of fasteners and the other of the flap and the front wall.

13. A re-sealable container system comprising:

a container including a front wall and a back wall, said back wall having a flap adapted to fold over said front wall;

a base label having a first side and a second side, at least one of said first and second sides adhered to at least one of the flap and the front wall;

a pair of hook-and-loop fasteners secured to the other of said first side and said second side, the other of the flap and the front wall secured over the pair of fasteners, wherein the pair of fasteners resealably close the container; and a cover label disposed between one of the pair of fasteners and the other of the flap and the front wall, wherein said cover layer includes an integral tear strip.

* * * * *